US009108100B2

(12) United States Patent
Reguis et al.

(10) Patent No.: US 9,108,100 B2
(45) Date of Patent: Aug. 18, 2015

(54) BOARD FOR SNOWBOARDING

(75) Inventors: Adrien Reguis, Grenoble (FR); Arnaud Repa, Le Fontanil Cornillon (FR)

(73) Assignee: Skis Rossignol (FR)

( * ) Notice: Subject to any disclaimer, the term of this patent is extended or adjusted under 35 U.S.C. 154(b) by 700 days.

(21) Appl. No.: 12/976,069

(22) Filed: Dec. 22, 2010

(65) Prior Publication Data

US 2011/0148075 A1 Jun. 23, 2011

(30) Foreign Application Priority Data

Dec. 23, 2009 (FR) ..... 09 59557

(51) Int. Cl.
*A63C 5/04* (2006.01)
*A63C 5/03* (2006.01)

(52) U.S. Cl.
CPC ..... *A63C 5/03* (2013.01); *A63C 5/0405* (2013.01)

(58) Field of Classification Search
CPC ..... A63C 5/03; A63C 5/04; A63C 5/0405
USPC ..... 280/609, 601, 602, 14.21, 14.22
See application file for complete search history.

(56) References Cited

U.S. PATENT DOCUMENTS

| | | | | |
|---|---|---|---|---|
| 5,275,428 | A * | 1/1994 | Bejean et al. | 280/602 |
| 6,102,428 | A * | 8/2000 | Bobrowicz | 280/607 |
| 6,382,658 | B1 * | 5/2002 | Stubblefield | 280/609 |
| 6,986,525 | B2 * | 1/2006 | Liard | 280/609 |
| 7,798,514 | B2 * | 9/2010 | Canaday et al. | 280/609 |
| 8,029,013 | B2 * | 10/2011 | Canaday et al. | 280/609 |
| 2002/0125661 | A1 * | 9/2002 | Haakonsen et al. | 280/14.22 |
| 2008/0106068 | A1 * | 5/2008 | Drake et al. | 280/601 |
| 2009/0256333 | A1 * | 10/2009 | Canaday et al. | 280/609 |
| 2010/0013191 | A1 * | 1/2010 | McKeever | 280/600 |
| 2011/0079986 | A1 * | 4/2011 | Gradman et al. | 280/609 |

FOREIGN PATENT DOCUMENTS

| | | | |
|---|---|---|---|
| EP | 1864696 | A1 | 12/2007 |
| EP | 1935459 | A1 * | 6/2008 |
| FR | 2791268 | A1 | 9/2000 |

OTHER PUBLICATIONS

Gavelda, Ben; Snowboard Camber Explained; Oct. 21, 2009, Transworld Snowboarding.*

French Search Report; Application No. FR 0959557; Aug. 11, 2010; 2 pages.

* cited by examiner

*Primary Examiner* — J. Allen Shriver, II
*Assistant Examiner* — Brian Cassidy
(74) *Attorney, Agent, or Firm* — St. Onge Steward Johnston & Reens LLC

(57) ABSTRACT

A board for snowboarding, having forward and rear contact lines; lines of greater width located beyond the forward and rear contact lines respectively; binding-mounting areas, each including a set of mounting points by which the binding is secured to the board; a non-zero camber (C), measured substantially midway between the forward and rear contact lines; forward and rear shovels; wherein seen from above, the forward and rear contact lines pass through forward and rear areas respectively, each delimited on the one hand, board center side, by an inner transverse line located at a maximum distance (D1,D3) of 50 mm relative to the central position of the binding-mounting area, and on the other hand, shovel side, by an outer transverse line located at a maximum distance (D2,D4) of 150 mm relative to the central position.

8 Claims, 1 Drawing Sheet

BOARD FOR SNOWBOARDING

CROSS-REFERENCE TO RELATED APPLICATIONS

The present application claims priority of pending French European patent application No. 0959557 filed on Dec. 23, 2009, the content of which is incorporated herein by reference.

FIELD OF THE INVENTION

The invention relates to the field of devices used for sliding on snow, and more specifically boards for use in snowboarding. It is related more specifically to a new board architecture with the geometric characteristics thereof being intended to improve maneuverability and control on compacted snow, while facilitating use on powder snow. In the remainder of the description, the different technical terms defining the geometric parameters of the sliding boards will be defined with reference to ISO standard 6289, or else by a specific definition where appropriate.

BACKGROUND OF THE INVENTION

Generally speaking, the boards used in snowboarding have seen their geometry evolve so that they can be adapted for use both on-piste, i.e. on compacted snow, and on powder snow. A present-day trend thus comprises using snow boards of shorter length to facilitate on-piste maneuvering. Complementarily, to retain sufficient lift, the boards have been modified in order to broaden them in the front (and rear), i.e. beyond the forward (and rear) contact line. The wider transverse lines in the front and rear can thus be placed on some models beyond the forward and rear contact lines.

A description has been given in the document EP-1 935 459 of a snow board which has such a geometry, wherein the running length, defined between the forward and rear contact lines, is shorter than the distance separating the wider lines. This amounts in practice to offsetting the contact lines by a few centimeters behind the wider lines, in such a way that the active sidecut when executing a turn exceeds the running length, thereby allowing the board to be maneuvered more easily when it is flat on the snow.

However, these boards do have one major drawback in that their camber, defined in a standardized way, is countered when the board is laden with a user, which therefore modifies their response relative to that defined by the intrinsic properties of the board (without the bindings and not laden).

SUMMARY OF THE INVENTION

A problem that the invention therefore proposes to resolve is that of improving board response by facilitating the maneuverability thereof on the basis of properties defined by the intrinsic geometry of the board. The invention thus relates to a board for snowboarding, which has:

- forward and rear contact lines;
- lines of greater width located beyond the forward and rear contact lines respectively;
- binding-mounting areas, each including a set of mounting points by which the binding is secured to the board;
- a non-zero camber, measured substantially midway between the forward and rear contact lines.

In accordance with the invention, said snowboard is characterized in that, when seen from above, the forward and rear contact lines pass through front and rear areas respectively, each delimited on the one hand, board center side, by an inner transverse line located at a maximum distance of 50 mm relative to the central position of the binding-mounting area, and on the other hand, shovel side, by an outer transverse line located at a maximum distance of 150 mm relative to this central position.

Put another way, the board is designed in such a way that the forward and rear contact lines are found substantially where the bindings are established, and in a preferred way on the outer side of the foot, i.e. on the side of the foot on which the stresses are applied. This configuration means that the natural camber of the board is not greatly disrupted, and in any event at least partially preserved when the user mounts the board. The presence of the camber allows two grip areas to be retained, substantially plumb with each foot. Stability is therefore ensured, despite a large reduction in the running length relative to traditional boards.

In practice, at the level of each binding, the optimum area for positioning the contact line is between two inner and outer transverse lines, which may be located at distances more or less close to the central position of the binding-mounting area, as a function of the influence that is required on the camber of the board when in use. The inner transverse line may thus be located 50 mm, 30 mm or 10 mm from the center of the binding-mounting area. Likewise, the outer transverse line may be 150 mm, 130 mm or 100 mm from the center of the binding-mounting area. The more centered this optimum area on the stress transmission area, the more the camber is preserved. Depending on the type of geometry of the mounting area, and particularly on the capacity thereof to accommodate bindings in multiple adjustment positions, the two transverse lines may be selected in accordance with the aforementioned predetermined locations.

In practice, the central position of the binding-mounting area corresponds to the middle (in the longitudinal direction) of the binding-mounting points, or to the middle of the binding centers between the two extreme positions of the binding. In a widely found type of binding, a mechanism is used for screwing the base plate, or an intermediary such as a disk, onto the board at four points formed by inserts built in when the board is manufactured. These mounting points could also be created after the board is manufactured, at the request of the user. There are also bindings wherein the number of locking points is different, without this departing from the framework of the present invention, in so far as it is possible to determine the center of the mounting area as being at the middle of the binding centers between the two extreme positions of the binding, which can be embodied by markers on the board. Reference may for example be made to the mechanism described in the document FR 2 791 268, according to which the center of the mounting area is in the middle of the rail into which the locking pin is inserted.

Furthermore, it is frequently the case that boards are designed so that the bindings can be mounted in a plurality of different positions, so as thereby to allow an adjustment of the "stance", or in other words the width between the feet of the user. This also allows the longitudinal position of the midpoint between the feet to be adjusted. In this case, the board has different inserts which are distributed longitudinally, from which the center of the mounting area can be defined, as being the center of mass of the centers of the mounting points for the different positions that the binding is able to adopt.

The invention thus comprises combining a positioning of the contact lines substantially plumb with the feet of the user with a board turn-up allowing optimized control when executing a turn.

According to another inventive feature, at a distance of 50 mm short of the wider lines, the running surface of the board is separated from the horizontal plane on which it lies by a non-zero distance, to advantage of less than 5 mm. These measurements are taken with the board laden at the center, its camber being canceled. It is important to note that at this distance short of the wider line, we are beyond the contact line, in the shovel, and not in the camber, unlike with conventional boards.

Indeed, it has been noted that the board turn-up forward from the forward contact line has a significant influence on the maneuverability and control thereof. Thus, when the board is perfectly flat, the portion of the edges in contact with the snow extends between the forward and rear contact lines. On the other hand, it should be noted that this is no longer the case when executing a turn, when the board is no longer lying flat on the snow. In this event, the portion of the sidecut which comes into contact with the snow extends beyond the forward and rear contact lines, and theoretically as far as the widest points of the board in the event of an extreme tilt. It has been determined that for the most widely used intermediate tilts, of about 30°, a compromise needs to be made as regards the way in which the board turns up beyond the contact lines. Thus, and according to one of the inventive features, this influence is determined by measuring the height of the board at a point located short of the wider lines, and typically at a distance of about 50 mm from said lines.

Thus, the height measured at these points will not have to be too large at the risk of too greatly reducing the length of the sidecut in contact with the snow in the event of a standard tilt. Conversely, this height must be not too low either since otherwise, when starting a turn, and for very small tilts, of about 10°, the sidecut grip points would be very much offset forwards and rearwards relative to the contact lines. Put another way, board maneuverability would be reduced because of the too low height of the characteristic point where the height in question is measured.

Thus, the compromise identified by the invention comprises having this height at the characteristic point located 50 mm short of the wider lines, which is between 0.5 and 6 mm, preferably between 1 and 5 mm, and very preferentially between 2 and 4 mm.

The characteristic positioning of the contact lines substantially in the binding-mounting areas, has the advantage that the intrinsic camber of the board is only slightly modified when the board is laden with the user, since most of the stresses caused by the weight of the user are applied in the immediate vicinity of the contact lines. The camber with board laden with the user is therefore very close to that of the non-laden board, in contrast to conventional boards. It will be noted therefore that the positions of the contact lines according to ISO standard 6289 are measured with a canceled camber, the board being laden at the center, whereas in normal operation, the inventive board is laden with the weight of the user in characteristic areas away from the center of the board, so that the camber is not canceled.

This characteristic positioning of the forward and rear contact lines may also be defined as a function of the different positions of the foot of the user. Thus, the invention may also be defined by the fact that, seen from above, the forward and rear contact lines pass through front and rear areas respectively, each delimited between two limit lines defined from the extreme positions of the longitudinal axis of the foot when the binding is oriented perpendicularly to the longitudinal axis of the board and in the extreme adjustment positions of said binding. To be more specific, these limit lines are located outside of the extreme positions of the longitudinal axis of the foot, and at a distance close to a foot half-width shovel side, and at a substantially smaller distance board center side.

Thus, on the inner side of the board, i.e. on the center side thereof, the boundary of the characteristic area is substantially in the position of the longitudinal axis of the foot when the binding is in the position closest to the center of the board.

Conversely, the outer characteristic boundary, i.e. the one located closest to the shovel, is at a distance of about 120 mm from the position of the longitudinal axis of the foot when the binding is in the extreme position closest to the shovel. In this way, in some binding swivel events, the contact line is underneath the sole of the shoe or the binding, and particularly the front or rear tip of the shoe or binding, through which some of the stresses are transmitted.

In one particular embodiment, the contact lines may pass through the areas, seen from above, formed by the mounting point envelope of each binding-mounting area. In other words, by joining the different points (10, 11) through which a binding may be mounted and secured to the board, a characteristic envelope (110, 111) is defined which is passed through by the contact line on the side under consideration.

The advantage in relation to the characteristic arrangement of the contact lines may be further enhanced by a complementary arrangement in respect of board thickness. Provision may thus be made to reduce the thickness of the board in a peripheral area.

Said area may extend over the entire periphery of the board, or be limited only to the front and rear portions, with a constant thickness being retained in the waist area as far as the lateral edges.

The reduction in thickness may give the shape of a bevel, with the sliding surface in these peripheral areas which forms a slight non-zero angle (typically of the order of a few degrees) relative to the sliding running surface in the central area thereof.

BRIEF DESCRIPTION OF THE DRAWINGS

The way in which the invention may be embodied together with the advantages arising there from, will become clearer from the description and the following embodiment, supported by the appended figures wherein.

Figure 1:
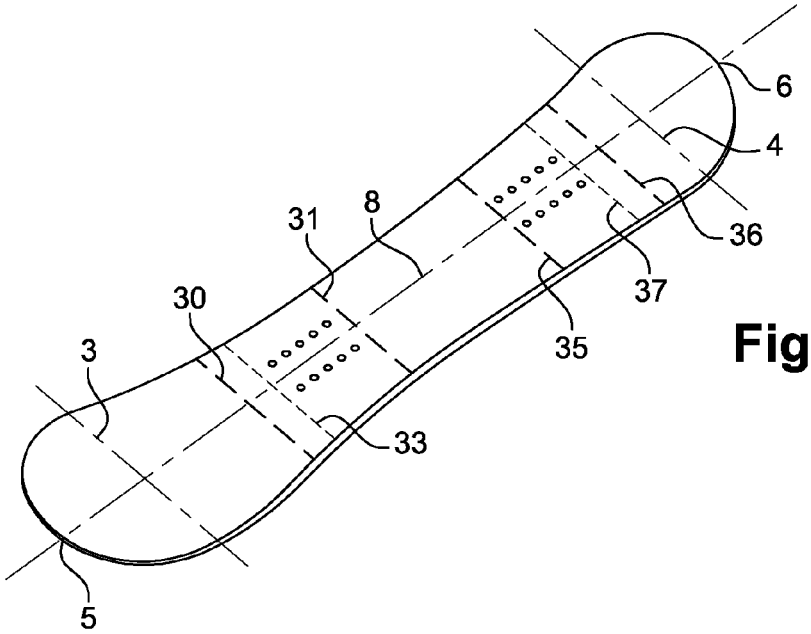
FIG. 1 is an outline perspective view of a snowboarding board in accordance with the invention

Clearly, the dimensions and different proportions featuring on the drawing are given for the main purpose of facilitating understanding of the invention, and may be at variance with the actual dimensions and proportions.

DETAILED DESCRIPTION OF THE INVENTION

Figure 2:
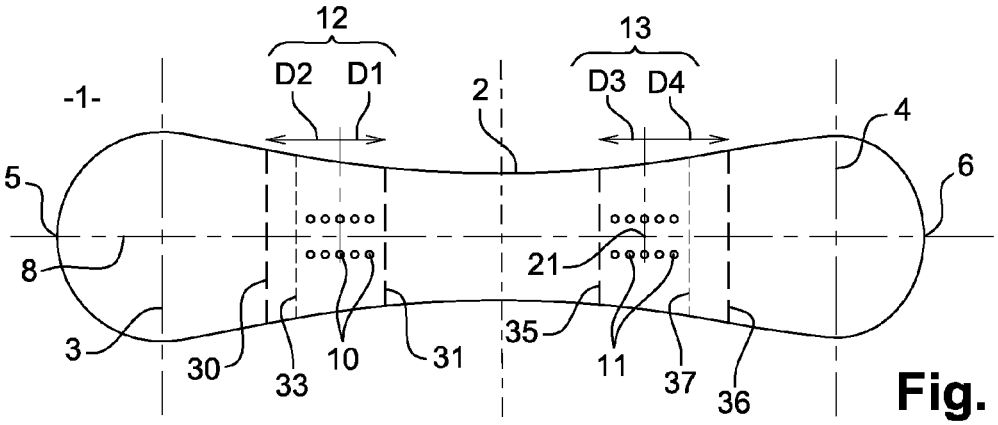
FIG. 2 is a view from above of a board in FIG. 1.

As shown in FIGS. 1 and 2, the sliding board 1 in accordance with the invention has a sidecut 2 whereof the portion coming into contact with the snow is of variable length depending on the tilt of the board relative to the ground surface. Said board 1 has two lines 3 and 4 where it has greater width, which may be identical or different between the front and the rear. These two lines may be at the same distance or at a different distance from the ends 5,6 of forward and rear shovels respectively.

Figure 3:
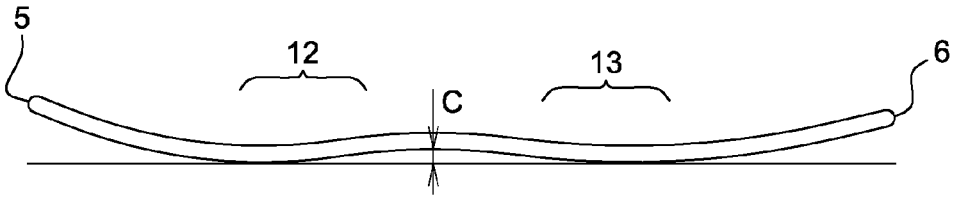
FIG. 3 is a side view of the board in FIG. 2 shown non-laden.

As shown in FIG. 3, the board has when at rest, i.e. non-laden, a camber (C), corresponding to the maximum height which separates the sliding running surface from a horizontal plane on which the board lies, a camber which is measured in practice substantially at mid-length between the two contact lines.

As shown in FIG. 2, the board 1 also comprises two binding-mounting areas. To be more specific, on the front of the board, the board has a plurality of mounting points 10 forming a set of a plurality of juxtaposed squares, and thereby defining the same number of possible positions for mounting the binding. This particular geometry is clearly not the only one that is conceivable, and it is possible for the binding area to be implemented via a set of inserts arranged differently, and particularly in staggered rows, in order to accommodate other types of binding. It is also possible, in a form not shown, to use bindings that are secured to the board not via discrete points, but using a rail mechanism that allows a continuous adjustment of the binding in the longitudinal direction, like the one described in the document FR 2 791 268.

Whatever type of binding and mounting point is used, it is possible to define a central point 20,21 as being the middle or center of symmetry of the different mounting points 10,11 of the binding. This point also corresponds to the intersection of the longitudinal axis of the foot, with the longitudinal axis 8 of the board when the binding is in its median position of longitudinal adjustment.

In accordance with the invention, the forward and rear contact lines of the board are defined so that they are located substantially in the binding-mounting area, and thereby in a preferred way receive direct pressure from the user. The contact lines are determined with the camber cancelled, using a 0.1 mm thick gage. To be more specific, as shown in FIG. 1, a characteristic area is defined between two lines 30,31 defined as follows: the line 30, located towards the shovel 5, is at a distance D2 from the point 20 of the center of the binding-mounting area. This line 30, directed crosswise relative to the board, defines the most divergent position of the forward contact line. On the other side of the binding-mounting area, the line 31 is defined as being apart by a distance D1 relative to the point 20 constituting the center of the binding-mounting area. In practice, the distances D1 and D2 are selected to be between 0 and 50 mm, and between 150 and 100 mm respectively.

According to one inventive feature, the forward contact line 33 is therefore between the two characteristic boundaries 30,31.

The same reasoning applies for the rear binding-mounting area, it being understood that the distances D3, D4 separating the characteristic lines 35,36 from the central point 21 of the binding-mounting, may be identical or different from those of the forward binding-mounting area.

Figure 4:
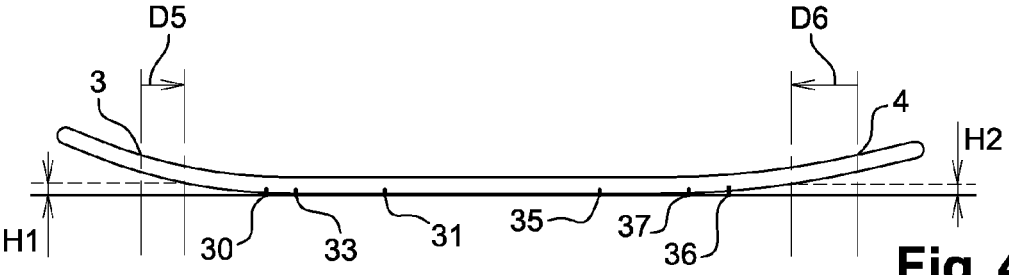
FIG. 4 is a view similar to FIG. 3, but showing the board laden at its center.

According to another inventive feature, and as shown in FIG. 4, the board has a gradual turn-up beyond the forward and rear contact lines, which is identified in order to confer an optimized response. To be more specific, at a distance D5 of 50 mm short of the wider line 3, the bottom surface of the board is separated from the horizontal plane on which the board lies, by a distance H1 of between 0.5 and 6 mm. In practice, this distance is measured when the board is laden at its center and its camber is therefore canceled.

On the rear shovel side of the board, a similar turn-up is measured, at a distance D6, also of 50 mm from the wider line 4. At this point, the bottom surface of the board is at a distance H2 from the horizontal plane on which it lies, said distance H2 being able to be equal to the distance H1 measured on the other side of the board, or once again different.

It is clear from what has been said above that the inventive sliding board has a great many advantages, particularly the possibility of being used both on compacted snow and powder snow, with the same ease of use and the same maneuverability.

What is claimed is:

1. A Board for snowboarding, having:

forward and rear contact lines;

forward and rear lines of greater width than, and located farther from a transverse center line of the board than, the forward and rear contact lines, respectively, the transverse center line of the board being transverse to the longitudinal axis of the board;

a first binding-mounting area located forward of the transverse center line of the board and a second binding-mounting area located rear of the transverse center line of the board, the first and second binding-mounting areas including first and second sets of mounting points, respectively, by which first and second bindings are securable to the board, respectively, each binding-mounting area having a transverse center line transverse to the longitudinal axis of the board;

forward and rear shovels;

wherein the transverse center of the board includes a non-zero camber when the board is non-laden;

wherein, when the center of the board is laden and the camber is cancelled, the forward and rear contact lines pass through front and rear areas respectively, the front and rear areas each including one of said binding-mounting areas therein and delimited by an inner line transverse to the longitudinal axis of the board and located at a maximum distance of 50 mm relative to the transverse center line of the binding-mounting area therein, and an outer line transverse to the longitudinal axis of the board and farther from the center line of the board than the inner line and located at a maximum distance of 150 mm relative to said transverse center line of the binding-mounting area therein.

2. The board for snowboarding, as claimed in claim 1, wherein the inner transverse line is located 30 mm from the central position of the binding-mounting area.

3. The board for snowboarding, as claimed in claim 1, wherein the inner transverse line is located 10 mm from the central position of the binding-mounting area.

4. The board for snowboarding, as claimed in claim 1, wherein the outer transverse line is located 130 mm from the central position of the binding-mounting area.

5. The board for snowboarding, as claimed in claim 1, wherein the outer transverse line is located 100 mm from the central position of the binding-mounting area.

6. The board for snowboarding, as claimed in claim 1, wherein, the forward and rear contact lines pass through a front and rear areas respectively formed by an envelope of the mounting points of each binding-mounting area.

7. The board for snowboarding, as claimed in claim 1, wherein, at a distance of 50 mm short of the forward line, and at a distance of 50 mm short of the rear line, the running surface of the board is separated from the horizontal plane on which it lies by a non-zero distance.

8. The board for snowboarding, as claimed in claim 7, wherein, at a distance of 50 mm short of the forward line, and at a distance of 50 mm short of the rear line, the running surface of the board is separated from the horizontal plane on which it lies by a distance of less than 5 mm.

* * * * *